US006735975B2

(12) United States Patent
Jeon

(10) Patent No.: US 6,735,975 B2
(45) Date of Patent: May 18, 2004

(54) APPARATUS FOR CONTROLLING COOL AIR OF REFRIGERATOR

(75) Inventor: Sang-Hyeon Jeon, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/403,056

(22) Filed: Apr. 1, 2003

(65) Prior Publication Data

US 2003/0188547 A1 Oct. 9, 2003

(30) Foreign Application Priority Data

Apr. 4, 2002 (KR) ..... 10-2002-0018688

(51) Int. Cl.[7] ..... F25D 17/09
(52) U.S. Cl. ..... 62/408; 62/126
(58) Field of Search ..... 62/126, 406, 408, 62/440, 441, 186–188

(56) References Cited

U.S. PATENT DOCUMENTS 3,645,108 A * 2/1972 Houk ..... 62/187
4,879,878 A * 11/1989 Polkinghorne ..... 62/187
5,778,694 A * 7/1998 Jeong ..... 62/187
6,647,740 B2 * 11/2003 Noritake ..... 62/408

* cited by examiner

*Primary Examiner*—Melvin Jones
(74) *Attorney, Agent, or Firm*—Fleshner & Kim, LLP

(57) ABSTRACT

An apparatus for controlling cool air of a refrigerator comprises: a damper arranged on a cool air flow path which supplies air cooled by passing through a freezing cycle to a chilling chamber, the damper for controlling an amount of cool air introduced into the chilling chamber; and a damper display means formed at one side of the cool air flow path for displaying a location of the damper. The apparatus which certifies an operation state of the damper from outside with a naked eye supplies cool air to the chilling chamber smoothly if the damper is not operated due to freeze. According to this, food in the chilling chamber is prevented from being decomposed or spoiled.

16 Claims, 6 Drawing Sheets

APPARATUS FOR CONTROLLING COOL AIR OF REFRIGERATOR

BACKGROUND OF THE INVENTION

1. Field of the Invention

The present invention relates to a refrigerator, and more particularly, to an apparatus for controlling cool air of a refrigerator which can certify a location of a damper with a naked eye, the damper refreshes food in the refrigerator by controlling an amount of cool air on a cool air flow path of an inner wall of the refrigerator.

2. Description of the Related Art

Generally, a refrigerator is a device to store food in low temperature, which is divided into a freezing chamber for freezing food and a chilling chamber for maintaining food fresh in a cold storage state.

FIG. 1 is a sectional view showing an entire structure of a refrigerator in accordance with the conventional art, and FIG. 2 is a sectional view line taken along line A-A' of FIG. 1.

As shown, the conventional refrigerator is divided into a freezing chamber 2 for freezing food and a chilling chamber 4 for cooling food with a predetermined temperature and maintaining the temperature, and a barrier 5 formed of an insulation material is inserted therebetween.

A freezing chamber door 60 for opening and closing the freezing chamber 2 is formed at one side of the freezing chamber 2, and a cooler chamber 1 and a cool air distribution chamber 15 which are divided from a shroud 12 are formed at the other side thereof.

The cooler chamber 1 of a left side of the shroud 12 is provided with a fan 8 for blowing cooling air at an upper portion thereof, and a heat exchanger 6 for cooling air by dehydrating the air at a lower portion thereof.

Also, a cool air flow path for supplying cool air to the chilling chamber 4 from the freezing chamber 2 is formed at an inner rear side or a lateral side of the refrigerator with a proper number at a proper position for a uniform cooling.

As shown in FIGS. 1 and 2, a cool air supply path 31 for supplying cool air is formed in the barrier 5 at one side of the freezing chamber 2, and the cool air supply path 31 is divided into a left flow path 32 and a right flow path 33.

A rear surface flow path 30 is formed at a rear surface of the chilling chamber 4 towards a longitudinal direction between the cool air supply path 31 and the left flow path 32, and a plurality of rear discharge openings 30*a* are formed below the rear surface flow path 30.

In the meantime, a left discharge opening 32*a* for sending cool air to the chilling chamber 4 is formed at a lower side of the left flow path 32 by being connected thereto, and a right discharge opening 33*a* for sending cool air to the chilling chamber 4 is formed at a lower side of the right flow path 33 by being connected thereto.

Also, a freezing chamber feedback flow path 2*a* and a cooling chamber feedback flow path 4*a* for returning air of high temperature to the heat exchanger 6 are formed at the barrier 5 located between the freezing chamber 2 and the chilling chamber 4.

As shown in FIG. 2, a damper 40 for controlling an amount of cool air sucked into the chilling chamber 4 from the freezing chamber 2 is mounted on the cool air flow path at an inner wall 10 of one side of the chilling chamber 4, and a chilling chamber door 70 for opening and closing the chilling chamber 4 is formed at the other side of the chilling chamber 4.

Also, a control unit for controlling the damper 40 is formed in the refrigerator. The control unit receives data about inner temperature from a temperature detecting sensor and compares the data with a predetermined temperature, thereby opening and closing the damper.

Meanwhile, a compressor 50 for compressing refrigerant is formed at one side of a lower portion of the refrigerator.

A flow of cool air in the refrigerator and operations of damper will be explained.

As shown in FIGS. 1 and 2, the cool air heat-exchanged by the heat exchanger 6 in the cooler chamber 1 formed at one side of the freezing chamber 2 flows into the freezing chamber 2 through the shroud 12 by the fan 8, and a part of the rest flows into the chilling chamber 4.

The cool air introduced into the chilling chamber 4 from the freezing chamber 2 is sucked to a suction opening formed at one side of a lower portion of the shroud 12, and passes the cool air supply path 31 formed at a lower part of the suction opening.

The cool air supplied to the cool air supply path 31 is diverged into the left flow path 32 and the right flow path 33.

A part of the cool air towards the left flow path 32 passes the rear surface flow path 30 arranged at a rear surface of the chilling chamber towards a longitudinal direction and is discharged through the plurality of rear discharge openings 30*a*, and another part of the cool air is discharged through the left discharge opening 32*a* formed at a left side of the chilling chamber 4.

The cool air towards the right flow path 33 is all discharged through the right discharge opening 33*a* formed at a right side of the chilling chamber 4.

At this time, the damper 40 arranged at an upper portion o the cool air flow path formed at one side wall of the chilling chamber 4 is operated, thereby controlling an amount of cool air introduced into the chilling chamber 4 from the freezing chamber 2.

Also, the control unit receives information about inner temperature from the temperature detecting sensor installed at an inner wall of the chilling chamber 4, and compares the information with a predetermined temperature, thereby selectively opening and closing the damper 40.

The air of high temperature by being introduced into the freezing chamber and the chilling chamber passes the freezing chamber feedback flow path 2*a* and the chilling chamber feedback flow path 4*a* formed in the barrier 5, and is introduced into the heat exchanger 6, thereby being cooled.

The cooled air is supplied to the freezing chamber or the chilling chamber by the heat exchanger above the damper. At this time, in order to reduce a power consumption and maintain a proper temperature in the refrigerator, the compressor is temporarily stopped. In this case, humid air in the chilling chamber which is relatively high temperature is frozen at a lower surface of the damper, so that the damper is not smoothly opened and closed.

According to this, in order to solve the freeze of the damper 40, heat is applied to a periphery of the damper.

However, the damper of the conventional refrigerator is installed on the cool air flow path of the inner wall of the chilling chamber, so that a user can not certify an operation state of the damper precisely at the time of opening a door of the chilling chamber and thus can not certify whether the cool air is normally supplied to the chilling chamber or not. According to this, food in the chilling chamber can be decomposed or spoiled.

SUMMARY OF THE INVENTION

Therefore, an object of the present invention is to provide an apparatus for controlling cool air of a refrigerator which can certify an operation state of a damper installed on a cool air flow path of the refrigerator with a naked eye, maintain a flow of the cool air, and thus store food fresh in the refrigerator.

To achieve these and other advantages and in accordance with the purpose of the present invention, as embodied and broadly described herein, there is provided an apparatus for controlling cool air of a refrigerator comprising: a damper arranged on a cool air flow path which supplies air cooled by passing through a freezing cycle to a chilling chamber, the damper for controlling an amount of cool air introduced into the chilling chamber; and a damper display means formed at one side of the cool air flow path for displaying a location of the damper.

The damper includes: a valve plate installed on the cool air flow path and operated up and down for controlling an amount of cool air; a hinge axis rotated by being attached to one side of the valve plate and being installed at one side wall on the cool air flow path; and a stepping motor connected to the hinge axis for operating the valve plate.

Also, the damper includes: a valve plate installed on the cool air flow path and operated up and down for controlling an amount of cool air; a rotation axis inserted to a center of a longitudinal direction of the valve plate for rotating the valve plate; and a stepping motor connected to one side of the rotation axis for transmitting a driving force to the valve plate.

The damper display means includes: a control means installed in the refrigerator for operating the valve plate up and down several times at the time of opening the refrigerator doors; and a window installed at one side wall of the cool air flow path as a vertical plate for certifying an operation of the damper with a naked eye.

Also, the damper display means includes: a control means installed in the refrigerator for operating the valve plate up and down several times at the time of opening the refrigerator doors; a window installed at one side of the cool air flow path for certifying an operation of the damper with a naked eye; and an indicator connected to one side of the rotation axis of the valve plate and simultaneously operated with the valve plate for certifying a location of the valve plate.

Also, the control means includes: a sensor attached to one side of the refrigerator and detected at the time of opening the refrigerator doors; and a controller for driving the stepping motor several times by receiving an electric signal of the sensor.

The window is convexly formed with an oval shape at a wall surface of the cool air flow path where the damper is located.

Also, the window is formed with a transparent material so that a user can see an operation of the valve plate from outside.

The window is formed to have the same length and width with the valve plate in order to watch an entire movement of the valve plate.

The window is formed to have the same width with the valve plate and have a length shorter than that of the valve plate in order to watch a movement of a part of the valve plate.

The indicator includes: a cylindrical lever body rotated by being integrally connected at one side of the rotation axis of the valve plate; and an indicator lever formed at a circumference surface of the lever body for displaying a location of the valve plate.

The indicator lever is formed as a square pillar of a predetermined length.

The indicator lever releases freeze of the valve plate by being rotated with the valve plate when the valve plate is not operated due to the freeze.

An indicator hole to which the indicator lever is inserted and moves is formed at one side of the window.

A cool air shielding film of an oval shape is integrally formed at the cool air flow path at both sides of the valve plate to prevent cool air from flowing outwardly.

Also, projections are formed at a central inner side of the window and at a corresponding inner wall of the cool air flow path in order to close the cool air flow path by supporting the valve plate when the valve plate is horizontally shut and thus blocks the cool air flow path.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
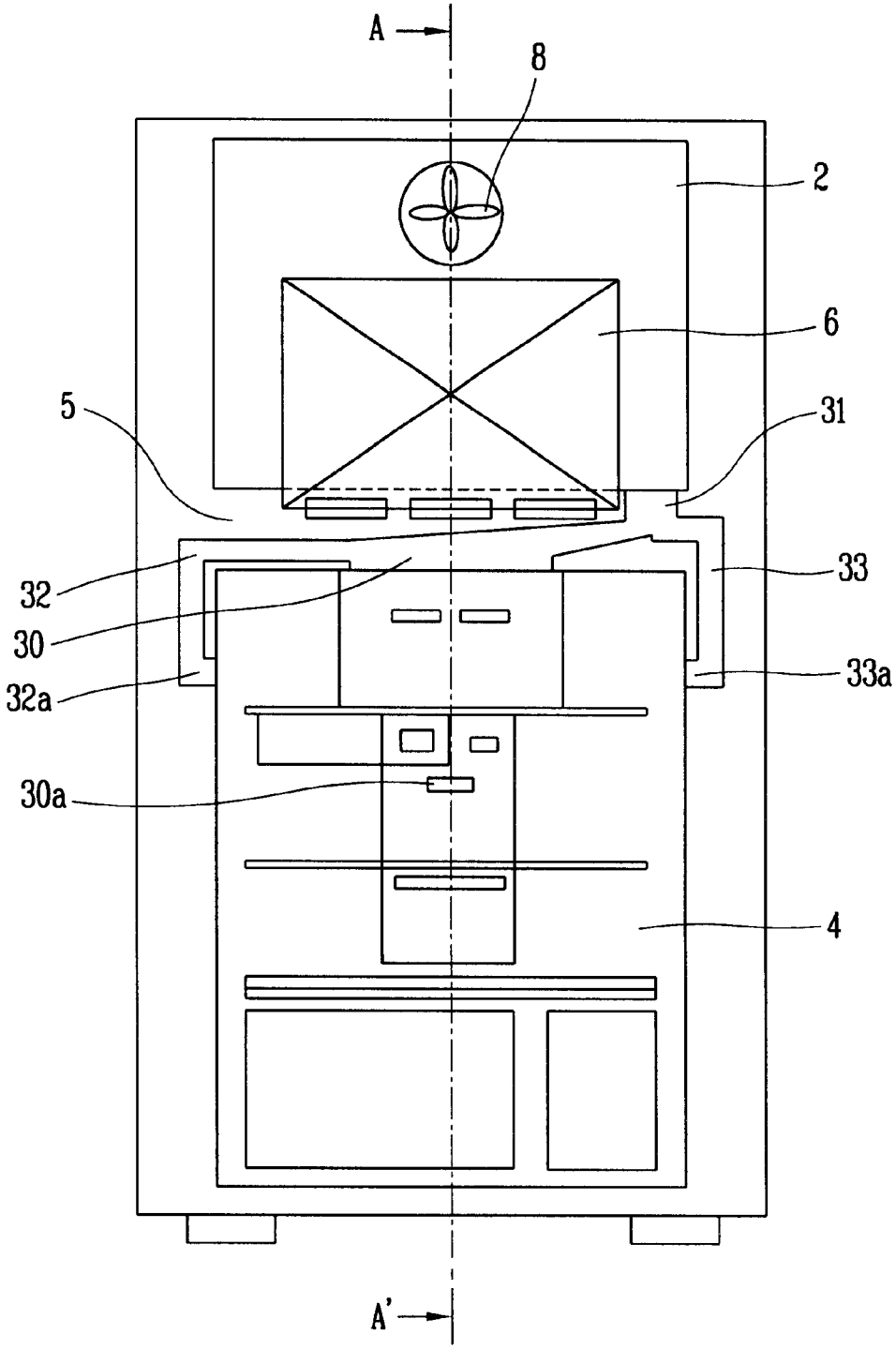
FIG. 1 PRIOR ART
FIG. 1 is a sectional view showing an entire structure of a refrigerator in accordance with the conventional art.
Figure 2:
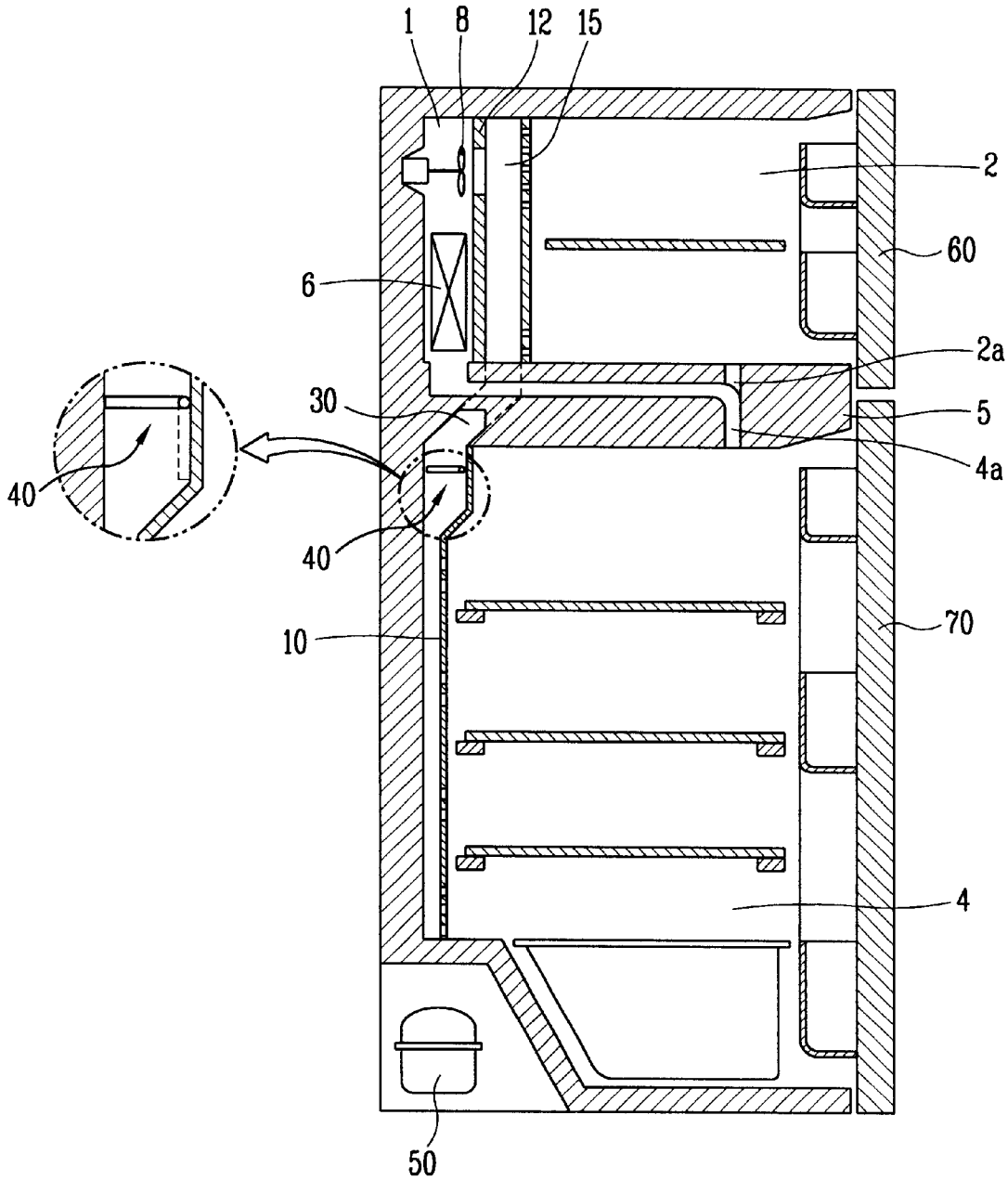
FIG. 2 PRIOR ART
FIG. 2 is a sectional view taken along line A-A' of FIG. 1.
Figure 3:
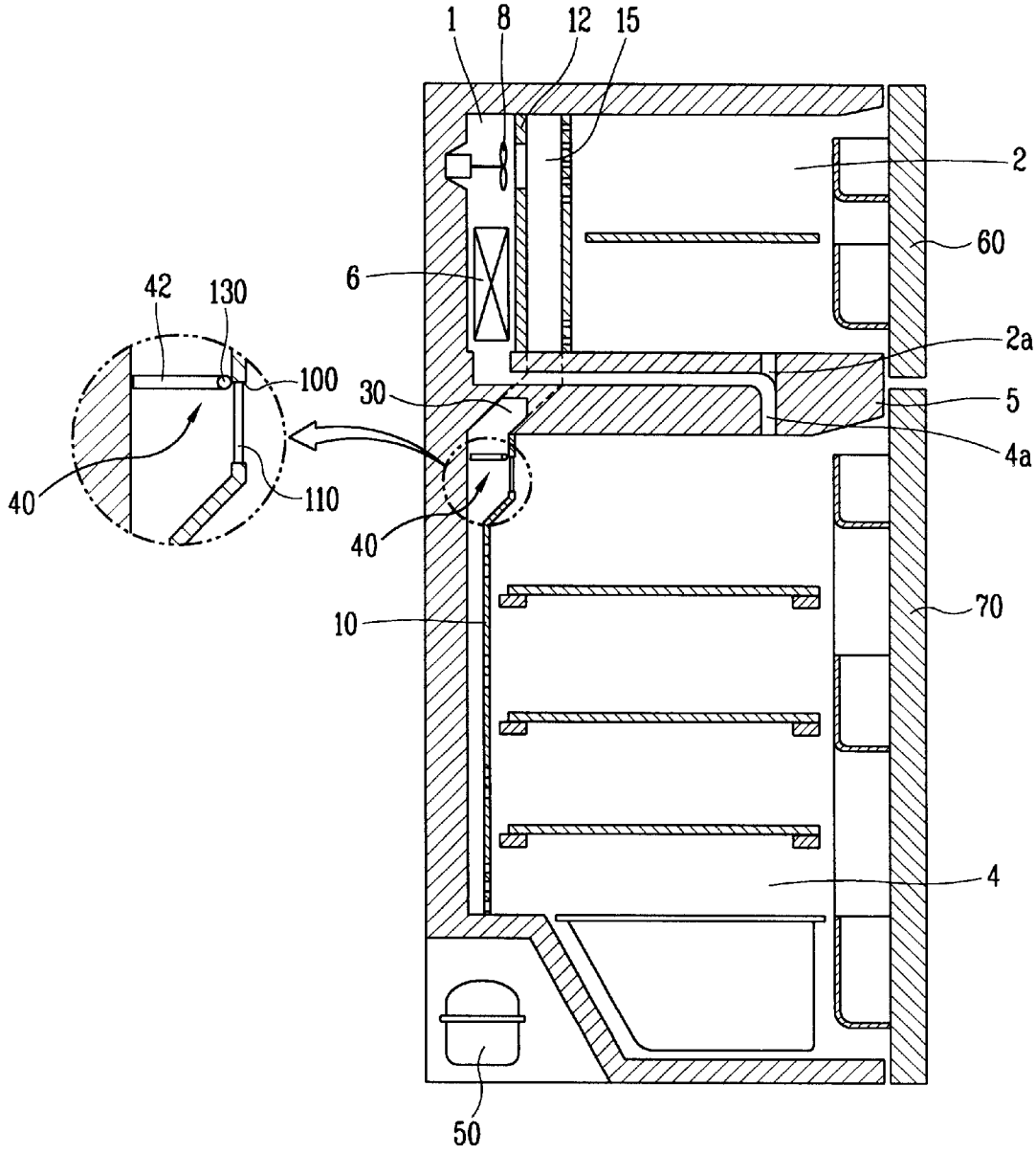
FIG. 3 is a cross-sectional view showing an entire structure of an apparatus for controlling cool air of a refrigerator according to the present invention.
Figure 4:
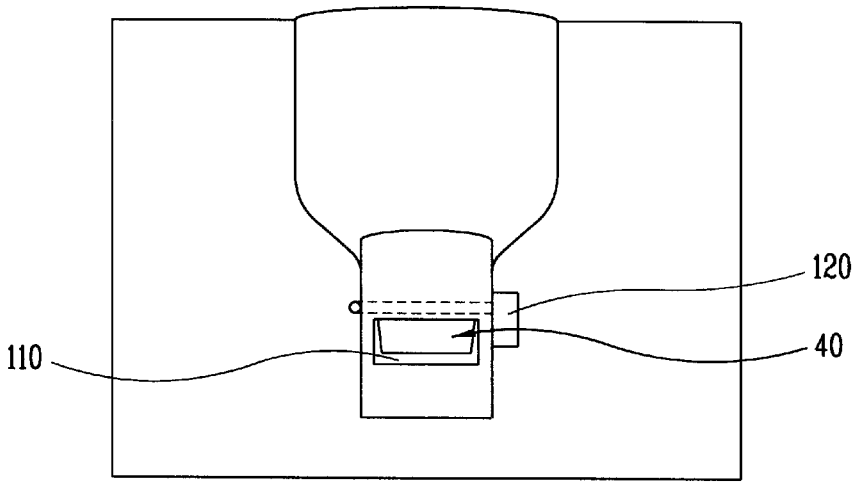
FIG. 4 is a front view showing a damper display means according to one embodiment of the apparatus for controlling cool air of a refrigerator according to the present invention.
Figure 5:
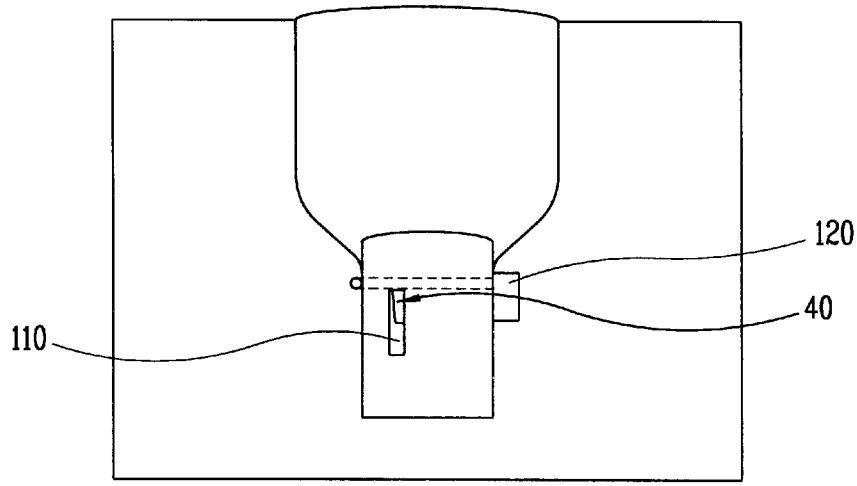
FIG. 5 is a front view showing a damper display means according to a second embodiment of the apparatus for controlling cool air of a refrigerator according to the present invention.
Figure 6:
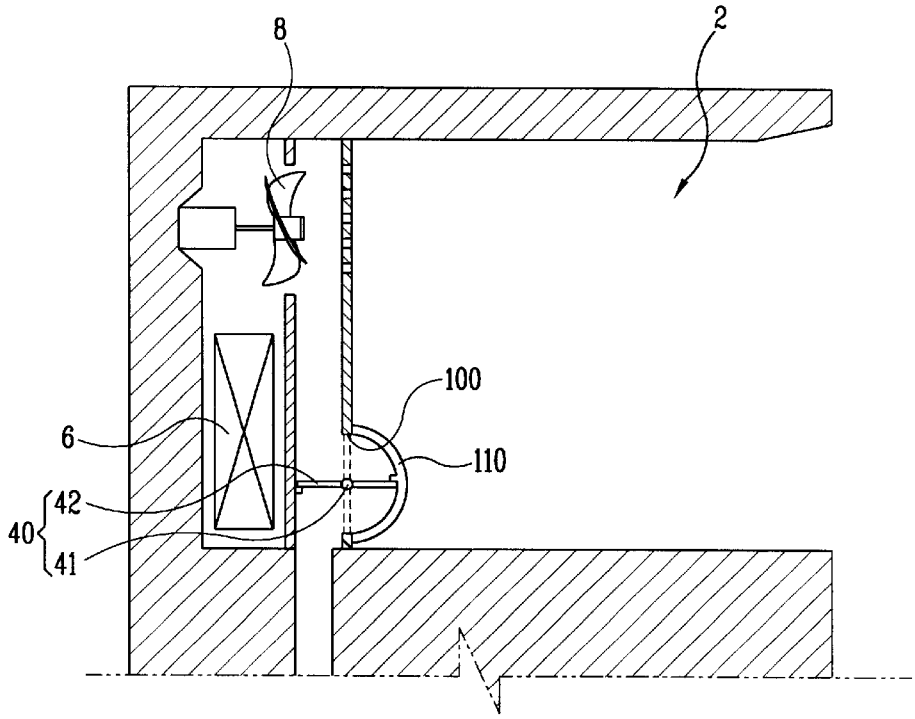
FIG. 6 is a cross-sectional view showing a damper and a damper display means of the apparatus for controlling cool air of a refrigerator according to the present invention.
Figure 7:
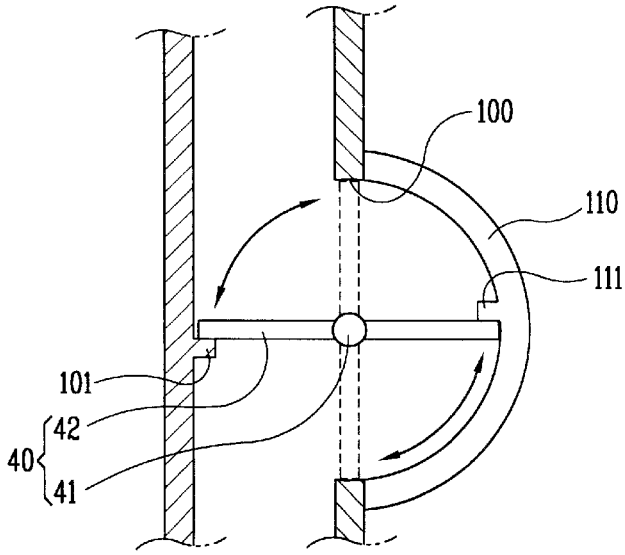
FIG. 7 is an enlarged section view of the damper shown in FIG. 6.
Figure 8:
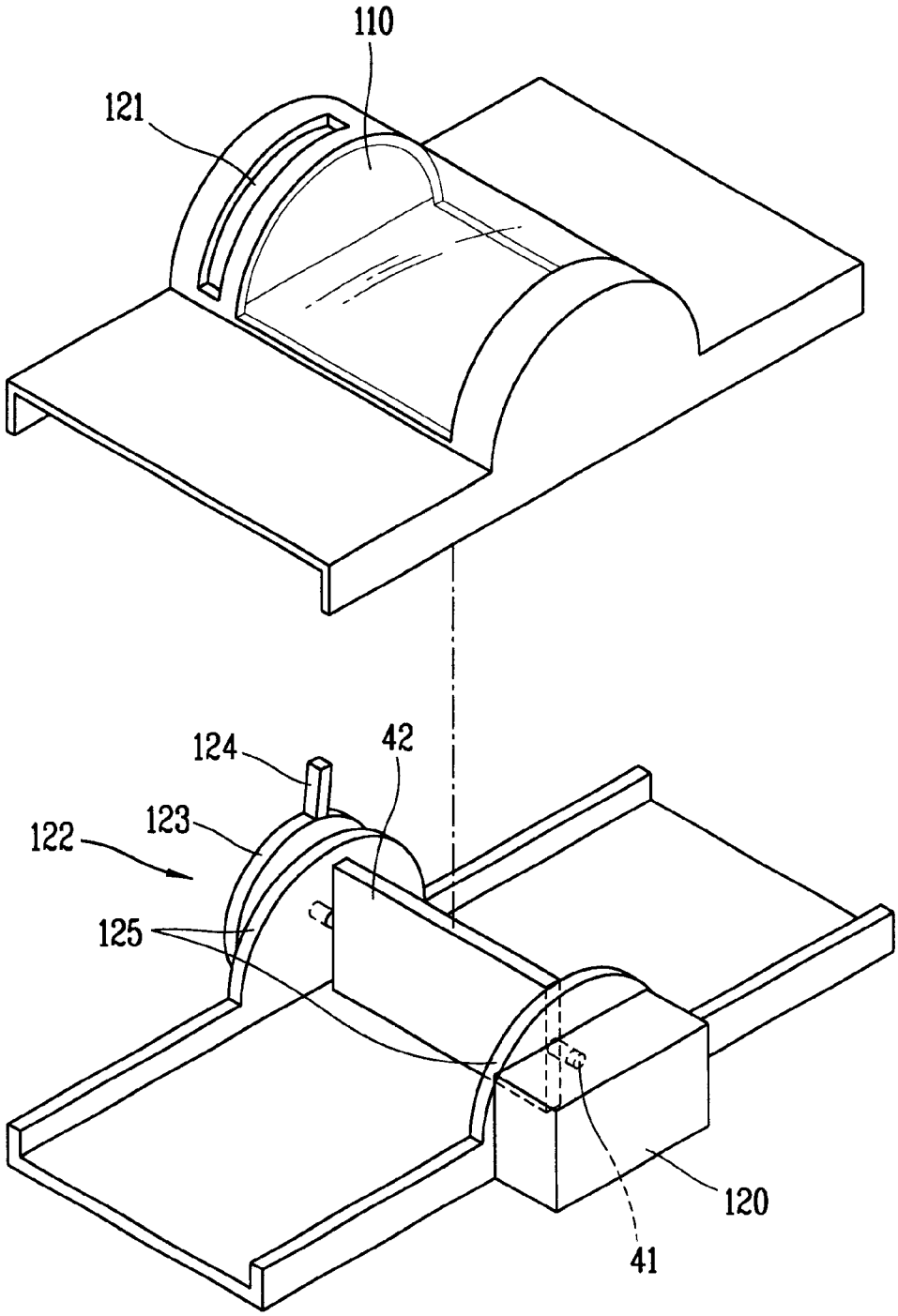
FIG. 8 is an disassembled perspective view showing a damper display means of the apparatus for controlling cool air of a refrigerator according to the present invention.

FIG. 3 is a cross-sectional view showing an entire structure of an apparatus for controlling cool air of a refrigerator according to the present invention, FIG. 4 is a front view showing a damper display means according to one embodiment of the apparatus for controlling cool air of a refrigerator according to the present invention, FIG. 5 is a front view showing a damper display means according to a second embodiment of the apparatus for controlling cool air of a refrigerator according to the present invention, FIG. 6 is a cross-sectional view showing a damper and a damper display means of the apparatus for controlling cool air of a refrigerator according to the present invention, FIG. 7 is an enlarged section view of the damper shown in FIG. 6, and FIG. 8 is an enlarged perspective view showing a damper display means of the apparatus for controlling cool air of a refrigerator according to the present invention.

As shown in FIGS. 3 to 5, the apparatus for controlling cool air of a refrigerator according to the first embodiment of the present invention is provided with a damper 40 arranged on a cool air flow path of an inner wall 10 of one side of a chilling chamber 4 for controlling an amount of cool air introduced into the chilling chamber 4 from the freezing chamber 2.

Also, a damper display means for displaying a location of the damper 40 is formed at one side of the cool air flow path.

The damper 40 includes: a valve plate 42 installed on the cool air flow path and operated up and down for controlling an amount of cool air; a hinge axis rotated by being attached to one side of the valve plate 42 and being installed at one side wall on the cool air flow path; and a stepping motor 120 connected to the hinge axis for operating the valve plate 42.

The damper display means includes: a control means installed in the refrigerator for operating the valve plate 42 up and down several times at the time of opening the refrigerator doors 60 and 70; and a window 110 installed at one side wall of the cool air flow path as a vertical plate for certifying an operation of the damper 40 with a naked eye.

Also, the control means includes: a sensor attached to one side of the refrigerator and detected at the time of opening the refrigerator doors; and a controller for driving the stepping motor 120 several times by receiving an electric signal of the sensor.

The window 110 is formed with a transparent material so that a user can see an operation of the valve plate 42 from outside.

The window 110 can be formed to have the same length and width with the valve plate 42 in order to watch an entire movement of the valve plate 42, or can be formed to have the same width with the valve plate 42 and have a length shorter than that of the valve plate 42 in order to watch a movement of a part of the valve plate 42.

As shown in FIGS. 3 to 8, the apparatus for controlling cool air of a refrigerator according to the second embodiment of the present invention is provided with a damper 40 arranged on a cool air flow path which supplies cool air to a chilling chamber for controlling an amount of cool air introduced into the chilling chamber, and a damper display means formed at one side of the cool air flow path for displaying a location of the damper.

The damper 40 includes: a valve plate 42 installed on the cool air flow path and operated up and down for controlling an amount of cool air; a rotation axis 41 inserted to a center of a longitudinal direction of the valve plate 42 for rotating the valve plate 42; and a stepping motor 120 connected to one side of the rotation axis 41 for transmitting a driving force to the valve plate 42.

The damper display means includes: a control means installed in the refrigerator for operating the valve plate 42 up and down several times at the time of opening the refrigerator doors; a window 110 installed at one side of the cool air flow path for certifying an operation of the damper 40 with a naked eye; and an indicator 122 connected to one side of the rotation axis 41 of the valve plate 42 and simultaneously operated with the valve plate 42 for certifying a location of the valve plate 42.

Also, the control means includes: a sensor attached to one side of the refrigerator and detected at the time of opening the refrigerator doors; and a controller for driving the stepping motor 120 several times by receiving an electric signal of the sensor.

The window 110 is convexly formed with an oval shape at a wall surface of the cool air flow path where the damper 40 is located.

Also, the window 110 is formed with a transparent material so that a user can see an operation of the valve plate 42 from outside.

As shown in FIGS. 4 and 5, the window 110 can be formed to have the same length and width with the valve plate 42 in order to understand an entire movement of the valve plate, or can be formed to have the same width with the valve plate 42 and have a length shorter than that of the valve plate 42 in order to understand a movement of a part of the valve plate 42.

As shown in FIG. 8, the indicator 122 includes: a cylindrical lever body 123 rotated by being integrally formed at one side of the rotation axis 41 of the valve plate 42; and an indicator lever 124 formed at a circumference surface of the lever body 123 for displaying a location of the valve plate 42.

The indicator lever 124 is formed as a square pillar of a predetermined length, and releases freeze of the valve plate 42 by being rotated with the valve plate 42 when the valve plate is not operated due to the freeze.

An indicator hole 121 to which the indicator lever 124 is inserted and moves is formed at one side of the window 110.

A cool air shielding film 125 of an oval shape is integrally formed at the cool air flow path at both sides of the valve plate 42 to prevent cool air from flowing outwardly.

Also, projections 101 and 111 are formed at a central inner side of the window 110 and at a corresponding inner wall_of the cool air flow path in order to close the cool air flow path by supporting the valve plate 42 when the valve plate 42 is horizontally shut and thus blocks the cool air flow path.

A flow and operations of cool air in the refrigerator will be explained.

As shown in FIGS. 1 to 5, cool air heat-exchanged by the heat exchanger 6 in the cooler chamber 1 formed at one side of the freezing chamber 2 flows into the freezing chamber 2 through the shroud 12 by the fan 8, and a part of the rest flows into the chilling chamber 4.

The cool air introduced into the chilling chamber 4 from the freezing chamber 2 is sucked to a suction opening formed at one side of a lower portion of the shroud 12, and passes the cool air supply path 31 formed at a lower part of the suction opening.

The cool air supplied to the cool air supply path 31 is diverged into the left flow path 32 and the right flow path 33.

A part of the cool air towards the left flow path 32 passes the rear surface flow path 30 arranged at a rear surface of the chilling chamber towards a longitudinal direction and is discharged through the plurality of rear discharge openings 30*a*, and another part of the cool air is discharged through the left discharge opening 32*a* formed at a left side of the chilling chamber 4.

The cool air towards the right flow path 33 is all discharged through the right discharge opening 33*a* formed at a right side of the chilling chamber 4.

At this time, the damper 40 arranged at an upper portion o the cool air flow path formed at one side wall of the chilling chamber 4 is operated, thereby controlling an amount of cool air introduced into the chilling chamber 4 from the freezing chamber 2.

Herein, in order to reduce a power consumption and maintain a proper temperature in the refrigerator, the fan 8 and the compressor 50 are temporarily stopped. In this case, humid air which is relatively high temperature is frozen at a lower surface of the valve plate 42, so that the damper 40 is not smoothly opened and closed.

According to this, in order to prevent said problem, an electric signal is transmitted to the controller through the sensor connected to the doors at the time of opening the refrigerator doors, and by an indication of the controller, the stepping motor 120 operates the valve plate 42 several times.

Also, the operation state of the valve plate 42 is certified, as shown in FIGS. 6 to 8, by the window 110 and the indicator 122.

Then, if the valve plate 42 is certified to be frozen, the user operates the valve plate 42 by moving the indicator lever 124 which is at one side of the transparent window 110.

Meanwhile, the air of high temperature by being introduced into the freezing chamber and the chilling chamber passes the freezing chamber feedback flow path 2*a* and the chilling chamber feedback flow path 4*a* formed in the barrier 5, and is introduced into the heat exchanger 6, thereby being cooled.

In the apparatus for controlling cool air of a refrigerator according to the present invention, the operation state of the damper installed on the cool air flow path can be certified with a naked eye by the window and the indicator from outside. Herein, if the damper is not operated due to freeze, the damper is operated by the indicator lever to smoothly supply cool air to the chilling chamber, thereby preventing food in the chilling chamber from being decomposed or spoiled.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling cool air of a refrigerator comprising:

a damper arranged on a cool air flow path which supplies air cooled by passing through a freezing cycle to a chilling chamber, the damper for controlling an amount of cool air introduced into the chilling chamber; and a damper display means formed at one side of the cool air flow path for displaying a location of the damper.

2. The apparatus of claim 1, wherein the damper includes:

a valve plate installed on the cool air flow path and operated up and down for controlling an amount of cool air;

a hinge axis rotated by being attached to one side of the valve plate and being installed at one side wall on the cool air flow path; and a stepping motor connected to the hinge axis for operating the valve plate.

3. The apparatus of claim 2, wherein the damper includes:

a valve plate installed on the cool air flow path and operated up and down for controlling an amount of cool air;

a rotation axis inserted to a center of a longitudinal direction of the valve plate for rotating the valve plate; and a stepping motor connected to one side of the rotation axis for transmitting a driving force to the valve plate.

4. The apparatus of claim 1, wherein the damper display means includes:

a control means installed in the refrigerator for operating the valve plate up and down several times at the time of opening the refrigerator doors; and a window attached to one side wall of the cool air flow path as a vertical plate for certifying an operation of the damper with a naked eye.

5. The apparatus of claim 4, wherein the damper display means includes:

a control means installed in the refrigerator for operating the valve plate up and down several times at the time of opening the refrigerator doors;

a window installed at one side of the cool air flow path for certifying an operation of the damper with a naked eye; and an indicator connected to one side of the rotation axis of the valve plate and simultaneously operated with the valve plate for certifying a location of the valve plate.

6. The apparatus of claim 4 or 5, wherein the control means includes:

a sensor attached to one side of the refrigerator and detected at the time of opening the refrigerator doors; and a controller for driving the stepping motor several times by receiving an electric signal of the sensor.

7. The apparatus of claim 5, wherein the window is convexly formed with an oval shape at a wall surface of the cool air flow path where the damper is located.

8. The apparatus of claim 7, wherein the window is formed with a transparent material so that a user can see an operation of the valve plate from outside.

9. The apparatus of claim 8, wherein the window is formed to have the same length and width with the valve plate in order to watch an entire movement of the valve plate.

10. The apparatus of claim 9, wherein the window is formed to have the same width with the valve plate and have a length shorter than that of the valve plate in order to watch a movement of a part of the valve plate.

11. The apparatus of claim 5, wherein the indicator includes:

a cylindrical lever body rotated by being integrally connected at one side of the rotation axis of the valve plate; and an indicator lever formed at a circumference surface of the lever body for displaying a location of the valve plate.

12. The apparatus of claim 11, wherein the indicator lever is formed as a square pillar of a predetermined length.

13. The apparatus of claim 11, wherein the indicator lever releases freeze of the valve plate by being rotated with the valve plate when the valve plate is not operated due to the freeze.

14. The apparatus of claim 7, wherein an indicator hole to which the indicator lever is inserted and moves is formed at one side of the window.

15. The apparatus of claim 5, wherein a cool air shielding film of an oval shape is integrally formed at the cool air flow path at both sides of the valve plate to prevent cool air from flowing outwardly.

16. The apparatus of claim 7, wherein projections are formed at a central inner side of the window and at a corresponding inner wall of the cool air flow path in order to close the cool air flow path by supporting the valve plate when the valve plate is horizontally shut and thus blocks the cool air flow path.

* * * * *